US009227110B2

(12) United States Patent
Ichikawa et al.

(10) Patent No.: US 9,227,110 B2
(45) Date of Patent: Jan. 5, 2016

(54) GOLF BALL HAVING MULTI-LAYER CORE WITH FILLER IN OUTER CORE

(75) Inventors: Yasushi Ichikawa, Tualatin, OR (US); Arthur Molinari, Beaverton, OR (US); Bradley C. Tutmark, Aloha, OR (US)

(73) Assignee: NIKE, Inc., Beaverton, OR (US)

( * ) Notice: Subject to any disclaimer, the term of this patent is extended or adjusted under 35 U.S.C. 154(b) by 480 days.

(21) Appl. No.: 13/433,642

(22) Filed: Mar. 29, 2012

(65) Prior Publication Data

US 2013/0260917 A1 Oct. 3, 2013

(51) Int. Cl.
*A63B 37/06* (2006.01)
*A63B 37/00* (2006.01)

(52) U.S. Cl.
CPC ..... *A63B 37/0064* (2013.01); *A63B 37/0003* (2013.01); *A63B 37/0039* (2013.01); *A63B 37/0059* (2013.01); *A63B 37/0062* (2013.01); *A63B 37/0065* (2013.01); *A63B 37/0066* (2013.01); *A63B 37/0075* (2013.01); *A63B 37/0076* (2013.01); *A63B 37/0043* (2013.01); *A63B 37/0045* (2013.01); *A63B 37/0046* (2013.01); *A63B 37/0047* (2013.01); *A63B 37/0061* (2013.01)

(58) Field of Classification Search
CPC ..... A63B 37/0039; A63B 37/0059
USPC ..... 473/373, 374, 377
See application file for complete search history.

(56) References Cited

U.S. PATENT DOCUMENTS 4,863,167 A 9/1989 Matsuki et al.
5,273,286 A 12/1993 Sun
6,010,412 A 1/2000 Moriyama et al.
7,066,837 B2 6/2006 Jordan
7,354,357 B2 4/2008 Sullivan et al.
7,410,429 B1 8/2008 Bulpett et al.
7,468,006 B2 12/2008 Sullivan et al.
7,517,289 B2 * 4/2009 Sullivan et al. ..... 473/376
7,651,415 B2 1/2010 Ladd et al.
7,744,489 B2 6/2010 Sullivan et al.
7,833,113 B2 11/2010 Sullivan et al.
2003/0144087 A1 7/2003 Rajagopalan et al.
2006/0178231 A1 8/2006 Kasashima
2006/0276596 A1 12/2006 Hayashi et al.
2007/0129172 A1 6/2007 Cavallaro
2010/0160081 A1 6/2010 Kim et al.
2011/0053707 A1 3/2011 Ishii et al.
2011/0130220 A1 6/2011 Ichikawa et al.
2012/0004052 A1 1/2012 Chou et al.

OTHER PUBLICATIONS

Notification of Transmittal of the International Search Report and the Written Opinion of the International Searching Authority in connection with International Patent Application No. PCT/US2013/034217 mailed on Aug. 23, 2013; 7 pages.

* cited by examiner

*Primary Examiner* — Raeann Gorden

(74) *Attorney, Agent, or Firm* — Honigman Miller Schwartz & Cohn LLP; Anna M. Budde; Jonathan P. O'Brien

(57) ABSTRACT

A golf ball includes an inner core and an outer core, both made of highly neutralized acid polymers. The inner core does not substantially include any fillers, while the outer core does include fillers. The outer core may include fillers in an amount of from about 17.% to about 30.7% by weight. The filler may be barium sulfate. The core made from the inner core and the outer core may have an unexpectedly higher coefficient of restitution.

13 Claims, 5 Drawing Sheets

GOLF BALL HAVING MULTI-LAYER CORE WITH FILLER IN OUTER CORE

BACKGROUND

1. Field of the Invention

The present disclosure relates generally to golf balls. Specifically, this disclosure relates to golf balls that include an inner core formed from a highly neutralized acid polymer, and an outer core that is also formed from a highly neutralized acid polymer, where the inner core does not include substantially any fillers but the outer core does include fillers.

2. Description of Related Art

Modern golf balls are known to be made from a variety of polymer materials. The material making up a golf ball may affect the golf ball's performance characteristics in several ways. For example, the selection of the material for use as a golf ball may affect the golf ball's coefficient of restitution, initial velocity off the tee, feel, durability over time, and other properties.

Suitable known materials for use in a golf ball include thermoset materials, such as rubber, styrene butadiene, polybutadiene, isoprene, polyisoprene, and trans-isoprene. Known materials also include thermoplastics, such as ionomer resins, polyamides or polyesters, and thermoplastic polyurethane elastomers. Suitable materials also include polyurea compositions, as well as other materials.

In particular, ionomers are often used for to form the various structural components of known golf balls. For example, ionomers such as Surlyn™ available from E.I. DuPont de Nemours & Company are known to be used for cover layers of golf balls. Other types of ionomers, generally referred to as highly neutralized acid polymers, may also be used in golf balls.

Specifically, highly neutralized acid polymers are known to be used as the material for a golf ball core. For example, U.S. Pat. No. 6,756,436 to Rajagopalan et al., entitled "Golf Balls Comprising Highly-Neutralized Acid Polymers" and filed Apr. 9, 2002, discloses golf balls having highly neutralized acid polymer cores. The disclosure of this patent is hereby incorporated by reference. Other conventional highly neutralized acid polymers are generally disclosed in U.S. Pat. No. 7,652,086 to Sullivan et al., entitled "Highly-neutralized Thermoplastic Copolymer Center for Improved Multi-layer Core Golf Ball" and filed Feb. 3, 2006, the disclosure of which is hereby incorporated by reference.

In some known golf ball constructions, a multi-piece golf ball may include both an inner core and an outer core. For example, U.S. Pat. No. 7,468,006 to Sullivan et al. discloses a golf ball having an inner core and an outer core. In particular, this patent teaches that one layer is made from a relatively soft highly neutralized acid polymer composition, and another layer is made from a relatively hard highly neutralized acid polymer composition. The disclosure of U.S. Pat. No. 7,468,006 to Sullivan et al. is hereby incorporated by reference.

The compositions of an inner core and outer core, or other layers of the golf ball, may be manipulated to achieve desired effects. For example, U.S. Pat. No. 7,651,415 to Ladd et al. discloses a golf ball with a core, intermediate layer(s), and cover layer(s) having a density gradient in its inner layers. The density of the innermost layer can be lowered with a density reducing filler, while outer layers include a density increasing filler. The disclosure of U.S. Pat. No. 7,651,415 to Ladd et al. is hereby incorporated by reference.

The selection of material(s) in the core, as well as the golf ball's overall construction, may affect the coefficient of restitution ("COR") in particular. As is widely known, the COR of a golf ball is a measure of how efficiently the golf ball transfers kinetic energy. A high COR value means that, when the golf ball is struck by a golf club, the golf ball transfers more of the kinetic energy of a golf club into forward movement by the golf ball. A high COR value may achieve advantageous play characteristics such as an increased initial velocity, or an increased total distance.

Therefore, there exists a need in the art for a golf ball having an increased COR that may also incorporate the advantages of using highly neutralized acid polymers to form an inner and outer core.

SUMMARY

Generally, this disclosure relates to golf balls constructed from a highly-neutralized polymer inner core and a highly neutralized acid polymer outer core, where the inner core includes little if any fillers while the outer core includes fillers. As a result of this construction, the golf ball may achieve advantageous effects of having an increase coefficient of restitution.

In one aspect, this disclosure provides a golf ball, the golf ball comprising: a center core, the center core comprising a first highly neutralized acid polymer; an outer core layer, the outer core layer substantially surrounding the center core and comprising a second highly neutralized acid polymer; and a cover layer, the cover layer substantially surrounding the outer core layer; wherein the center core is substantially free from filler, and the outer core layer contains at least 15% by weight filler.

In another aspect, this disclosure provides a golf ball, the golf ball comprising: a core, the core comprising an inner core consisting essential of a first highly neutralized acid polymer, and an outer core layer substantially surrounding the inner core and consisting essential of a second highly neutralized acid polymer composition and a filler; and a layer, the cover layer substantially surrounding the core; wherein the inner core contains less than about 0.01% by weight filler; and the outer core layer contains from about 17.0% to about 30.7% by weight $BaSO_4$ filler, and from about 69.3% to about 83.0% by weight of the second highly neutralized acid polymer.

In yet another aspect, this disclosure provides a golf ball, the golf ball comprising: a core, the core comprising an inner core and an outer core; the inner core consisting essential of a first highly neutralized acid polymer and less than about 0.01% by weight filler, the inner core having a diameter of from about 0.751 inches to about 1.266 inches, a specific gravity of about 0.96 g/cm$^3$, a compression value of from about 110 to about 170, and a Shore D hardness value of from about 37 to about 41; the outer core substantially surrounding the inner core, and consisting essential of from about 69.3% to about 83.0% by weight of a second highly neutralized acid polymer and from about 17.0% to about 30.7% by weight $BaSO_4$ filler; the core having a diameter of about 1.5 inches, a specific gravity of from about 1.09 to about 1.13 g/cm$^3$, a compression value of from about 87 to about 112, and a Shore D hardness value of about 43; and a cover layer, the cover layer substantially surrounding the core.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Generally, this disclosure relates to golf balls that include an inner core formed from a highly neutralized acid polymer that does not substantially include fillers and an outer core formed from a highly neutralized acid polymer that does include fillers. The core (including the inner core and outer core) made in this way may have an unexpectedly high COR value.

As used herein, unless otherwise stated, certain material properties and golf ball properties are defined as follows.

The term "hardness" as used herein is measured generally in accordance with ASTM D-2240. The hardness of a material is taken as the slab hardness, while the hardness of a golf ball component is measured on the curved surface of the molded golf ball component. When a hardness measurement is made on a dimpled cover, hardness is measured on a land area of the dimpled cover. Hardness units are generally given in Shore D unless otherwise indicated. Measurements of the hardness of an inner core, or outer core, herein are made on the curved surface of that component.

The "coefficient of restitution" or "COR" is measured generally according to the following procedure: a test object is fired by an air cannon at an initial velocity of 40 m/sec, and a speed monitoring device is located over a distance of 0.6 to 0.9 meters from the cannon. After striking a steel plate positioned about 1.2 meters away from the air cannon, the test object rebounds through the speed-monitoring device. The return velocity divided by the initial velocity is the COR.

The "flexural modulus" is measured generally in accordance with ASTM D-790.

The term "compression deformation," or just "compression," as used herein indicates the deformation amount under a force. Specifically, the compression deformation is the deformation amount under a compressive load of 130 kg minus the deformation amount under a compressive load of 10 kg.

The "Vicat softening temperature" is measured generally in accordance with ASTM D-1525.

Except as otherwise discussed herein below, any golf ball discussed herein may generally be any type of golf ball known in the art. Namely, unless the present disclosure indicates to the contrary, a golf ball may generally be of any construction conventionally used for golf balls, such as a conforming or non-conforming construction. Conforming golf balls are golf balls which meet the Rules of Golf as approved by the United States Golf Association (USGA). Golf balls discussed herein may also be made of any of the various materials known to be used in golf ball manufacturing, except as otherwise noted.

Furthermore, it is understood that any feature disclosed herein (including but not limited to various embodiments shown in the FIGS. and various chemical formulas or mixtures) may be combined with any other features disclosed here, as may be desired, in any combination, sub-combination, or arrangement.

Figure 1:
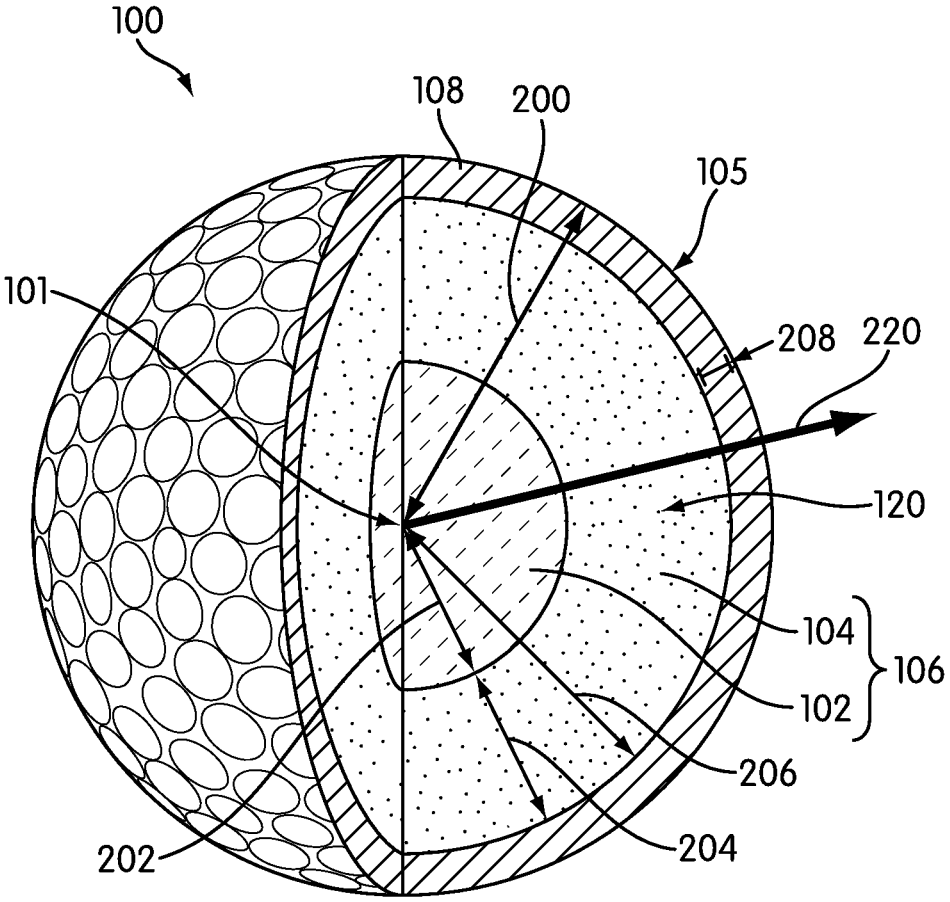
FIG. 1 shows a first representative golf ball in accordance with this disclosure, the golf ball having an inner core, an outer core, and a cover layer.

FIG. 1 shows a first embodiment of a golf ball in accordance with this disclosure. Golf ball 100 is a three-piece golf ball. Namely, golf ball 100 includes: inner core 102, outer core 104, and cover layer 108. Inner core 102 and outer core 104 may collectively be referred to as core 106. Golf ball 100 may have radius 200 that extends from center 101 to outermost surface 105. In various embodiments, radius 200 may have a value such that golf ball 100 is conforming to USGA standards, or may have another value.

Inner core 102 may be the innermost structural layer of golf ball 100, that includes center 101 of golf ball 100. Inner core 102 may therefore be substantially spherical. Inner core 102 may have radius 202. Radius 202 may have a value of from about 0.3755 inches to about 0.633 inches. In other words, inner core 102 may have a diameter of from about 0.751 inches to about 1.266 inches.

Outer core 104 may substantially surround inner core 102. That is, outer core 104 may be located radially outward from inner core 102 and be adjacent thereto. Outer core 104 may have thickness 204. Generally, core 106 may have a radius 206. In some embodiments, radius 206 may be equal to about 1.5 inches. Thickness 204 may therefore have any value that sums to about 1.5 inches in conjunction with radius 202 of inner core 102.

Inner core 102 and outer core 104 may be made from certain materials in order to achieve desired material properties and desired COR values. In some embodiments, inner core 102 and/or outer core 104 may be made from polymer materials. Specifically, inner core 102 may include a first highly neutralized acid polymer. Inner core 102 generally may include no substantial amount of fillers. For example, inner core 102 may include less than about 0.1% by weight fillers, or less than about 0.01% by weight fillers, or substantially 0.0% by weight fillers. Inner core 102 may consist essentially of the first highly neutralized acid polymer, or may consist of only the first highly neutralized acid polymer.

Outer core 104 may comprise a second highly neutralized acid polymer, while also comprising fillers. For example, outer core 104 may comprise at least about 15% by weight fillers 120, or at least about 17% by weight fillers 120, or from about 17% to about 30.7% by weight fillers 120. Amounts of fillers 120 that are significantly less than 15% by weight may be insufficient to achieve the desired effects in the desired magnitudes. Amounts of fillers 120 that are significantly more than 30.7% by weight may run into limitations based on USGA rules regarding the total mass of the golf ball (in embodiments where the golf ball is a regulation golf ball meeting USGA requirements), or other concerns such as a decrease in COR or a decrease in durability. The preferred amount of filler 120 present in outer core 104 may also be affected by the physical properties of other structural components of the cover ball. For example, a preferred amount of filler 120 may be affected by the relative sizes of radius 202 of inner core 102 and thickness 204 of outer core 104. As another example, a preferred amount of filler 120 may be affected by the specific gravity of the cover layer 108.

In some embodiments, outer core 104 may comprise from about 69.3% to about 83.0% by weight highly neutralized acid polymer. Outer core 104 may consist essentially of the second highly neutralized acid polymer and the filler, or may consist of only the second highly neutralized acid polymer and the filler.

Generally, the first highly neutralized acid polymer and the second highly neutralized acid polymer may be the same or different. In some embodiments, the first highly neutralized acid polymer and the second highly neutralized acid polymer may be the same type of highly neutralized acid polymer. In other embodiments, they may be entirely different types of highly neutralized acid polymers. Either or both of the first and second highly neutralized acid polymer may also comprise a mixture of two or more types of highly neutralized acid polymers. For example, two types of highly neutralized acid polymers may be mixed in any general ratio, such as 25:75 or 50:50, to form either or both of the first and second highly neutralized acid polymers.

Generally, a highly neutralized acid polymer is a type of ionomer. An ionomer is generally understood as any polymer material that includes ionized functional groups therein. Ionomeric resins are often ionic copolymers of an olefin and a salt of an unsaturated carboxylic acid. The olefin may have from about 2 to about 8 carbon atoms, and may be an alpha-olefin. The acid may be an unsaturated monocarboxylic acid having from about 3 to about 8 carbon atoms, and may be an alpha, beta-unsaturated carboxylic acid. Commonly, ionomers are copolymers of ethylene and either acrylic acid or methacrylic acid. In some circumstances, an additional comonomer (such as an acrylate ester, i.e., iso- or n-butylacrylate, etc.) can also be included to produce a terpolymer. These ionomers may be referred to as ethylene/(meth)acrylic acid ionomers, and ethylene/(meth)acrylic acid/alkyl(meth)acrylate ionmers respectively. A wide range of ionomers are known to the person of ordinary skill in the art of golf ball manufacturing.

When a large portion of the acid groups in the ionomer is neutralized by a cation, the ionomer material may then be considered to be a highly neutralized acid polymer. Generally, such a polymer is considered highly neutralized when at least 70% of the acid groups are neutralized by a cation. In various embodiments, the highly neutralized acid polymer may be neutralized to at least 75%, at least 80%, at least 85%, at least 90%, at least 95%, at least 98%, at least 99%, or substantially 100%. The cation may be any suitable cation source, such as the alkali metals and alkaline cation metals, particularly magnesium, sodium, zinc, or potassium.

Highly neutralized acid polymers are widely known in the art of golf ball construction. Suitable highly neutralized acid polymer compositions may include HPF resins such as HPF1000, HPF2000, HPF AD1027, HPF AD1035, HPF AD1040 and mixtures thereof, all produced by E. I. DuPont de Nemours and Company.

Inner core 102 and outer core 104 may be formed via any process known to be used with highly neutralized acid polymers. For example, either or both of inner core 102 and outer core 104 may be formed by a fabrication method such as hot-press molding or injection molding. When inner core 102 is manufactured by injection molding, the temperature of an injection molding machine may be controlled to be between 195° C. to 225° C.

Fillers are also known to be used in golf ball construction. For the purposes of this disclosure, a filler is any non-polymeric material that is added to a polymer in order to change one or more physical properties of the polymer.

Suitable additives and fillers for use in a highly neutralized acid polymer composition may include, for example, blowing and foaming agents, optical brighteners, coloring agents, fluorescent agents, whitening agents, UV absorbers, light stabilizers, defoaming agents, processing aids, mica, talc, nanofillers, antioxidants, stabilizers, softening agents, fragrance components, plasticizers, impact modifiers, acid copolymer wax, surfactants; inorganic fillers, such as zinc oxide, titanium dioxide, tin oxide, calcium oxide, magnesium oxide, barium sulfate, zinc sulfate, calcium carbonate, zinc carbonate, barium carbonate, mica, talc, clay, silica, lead silicate, and the like; high specific gravity metal powder fillers, such as tungsten powder, molybdenum powder, and the like; regrind, i.e., material that is ground and recycled; and nano-fillers. Suitable melt flow modifiers include, for example, fatty acids and salts thereof, polyamides, polyesters, polyacrylates, polyurethanes, polyethers, polyureas, polyhydric alcohols, and combinations thereof.

In particular embodiments, the filler may be used to change the specific gravity of the material. Such fillers may be referred to as density-adjusting fillers. Density adjusting fillers may include zinc oxide, barium sulfate, calcium carbonate, or magnesium carbonate. Metal powder, such as tungsten, may also be used as a filler to achieve a desired specific gravity. In some embodiments, barium sulfate ($BaSO_4$) in particular may be used. Barium sulfate has CAS number 7727-43-7, and is commercially available from a variety of chemical companies. The filler as discussed above may therefore comprise barium sulfate, consist essentially of barium sulfate, or consist only of barium sulfate, in various embodiments.

In some embodiments, inner core 102 does not include substantially any type of filler, while outer core 104 includes at least a desired amount of any type of filler. In other embodiments, the filler which is present in outer core 104 but is not present in inner core 102 may be a specific type of filler. For example, inner core 102 may include substantially zero amount of a density-adjusting filler, while outer core 104 may include density-adjusting fillers, in particular. In such embodiments, inner core 102 may therefore include fillers other than density-adjusting fillers so long as inner core 102 does not substantially include any density-adjusting fillers. For example, inner core 102 may include a coloring agent, so long as inner core 102 does not substantially include substantially any density-adjusting fillers. Outer 104 may therefore include density-adjusting fillers in the desired amounts, and may also include other types of fillers additionally.

As a result of the above compositions, specifically the arrangement of filler and lack thereof, inner core 102 and outer core 104 may have any of various desired physical properties.

First, core 106 and its subcomponents inner core 102 and outer core 104 may have desired specific gravity values. For example, inner core 102 may have a specific gravity of from about 0.95 g/cm$^3$ to about 1.05 g/cm$^3$. In other embodiments, inner core 102 may have a specific gravity that is less than about 1.00 g/cm$^3$, or a specific gravity that is about 0.96 g/cm$^3$. Outer core 104 may generally have a specific gravity of from about 1.05 g/cm$^3$ to about 1.25 g/cm$^3$. Accordingly, core 106 may have a specific gravity of from about 1.09 g/cm$^3$ to about 1.13 g/cm$^3$.

These specific gravity values may result from the presence of a heavy density-adjusting filler in outer core 104, while inner core 102 is substantially free from the heavy density-adjusting filler. As a result, golf ball 100 may have a moment of inertia 220 that is greater than it would otherwise be without this arrangement of fillers. Moment of inertia, also referred to as "MOI" in the art and herein, is a measure of the resistance to twisting about a central axis. The higher the MOI of an object, the more force will be required to change the object's rotationally velocity. Conversely, the lower the MOI, the less force will be needed to change how fast the object rotates.

For example, golf ball 100 may have a moment of inertia 220 of from about 82 g*cm$^2$ to about 90 g*cm$^2$. Moment of inertia 220 as shown in FIG. 1 indicates that golf ball 100 has a high moment of inertia because more of the mass of golf ball 100 is located more towards the surface 105 of golf ball 100 than towards the center 101 of golf ball 100, due to the lack of filler in inner core 102 but the presence of filler in outer core 104.

Next, core 106 and its subcomponents may have desirable compression values. For example, inner core 102 may have a compression value of from about 110 to about 170. Core 106 may also have a compression value of from about 87 to about 112.

The arrangement of fillers discussed above may also result in core 106 and its subcomponents having certain hardness values. For example, inner core 102 may have a Shore D hardness value of from about 37 to about 41. Core 106 may also have a Shore D hardness value of about 43. In some embodiments, inner core 102 may have a first hardness value, core 106 may have a second hardness value, where the second hardness value is at least about 2 Shore D greater than the first hardness value.

Each of inner core 102 and outer core 104 may have a highly uniform hardness. For example, inner core 102 may have a Shore D cross-sectional hardness difference between any two points on the cross-section of inner core 102 that is within +/−6 Shore D units, or within +/−3 Shore D units. Outer core 104 may also have a Shore D cross-sectional hardness difference between any two points on the cross-section of inner core 102 that is within +/−6 Shore D units, or within +/−3 Shore D units. The uniform hardnesses in these layers may lead to greater predictability of performance for the golfer.

The coefficient of restitution of core 106 may also be affected by the arrangement of fillers. Specifically, the presence of fillers 120 in outer core 104 combined with the substantial absence of fillers in inner core 102 may result in core 106 having an unexpectedly high COR value. In some embodiments, core 106 may have a COR value that is from about 0.815 to about 0.830.

More particularly, core 106 may have an actual measured COR value that is greater than a predicted COR value. The predicted COR value for core 106 may be calculated according to any of a variety of methods. In a particular embodiment, the predicted COR value of a two-piece core (such as core 106) having an "inner" component and an "outer" component may be calculated according to the following formula:

$$\text{Predicted } COR = \frac{\text{Volume inner}}{\text{Total Volume}} * COR \text{ inner} + \frac{\text{Volume outer}}{\text{Total Volume}} * COR \text{ outer} \quad \text{(Formula 1)}$$

In Formula I, the total volume of the core is the sum of the volume of the inner component and the volume of the outer component. The "COR inner" is determined by measuring the COR of the material making up the inner material, namely by measuring a uniform sphere of the material having a diameter of (for example) 1.55 inches under the same COR testing conditions (for example, 125 ft/sec). The "COR outer" is measured in the same manner with respect to the material making up the outer component.

In some embodiments, the COR of core 106 may be at least about 1% greater than the predicted COR. In other embodiments, the COR of core 106 may be at least about 2% greater than the predicted COR.

Golf ball 100 also includes cover layer 108. Cover layer 108 may substantially surround outer core 104. That is, cover layer 108 may be located radially outward from outer core 104 and adjacent thereto. Generally, cover layer 108 may be manufactured from any suitable material, such as Surlyn® or thermoplastic polyurethane, that is commonly used for golf ball covers. As shown in FIG. 1, cover layer 108 may have thickness 208. Thickness 208 may generally have any value. If golf ball 100 conforms to USGA rules requiring a total diameter of not less than 1.680 inches, then thickness 208 may have any value that compliments the above discussed values of the diameter of core 106.

Figure 2:
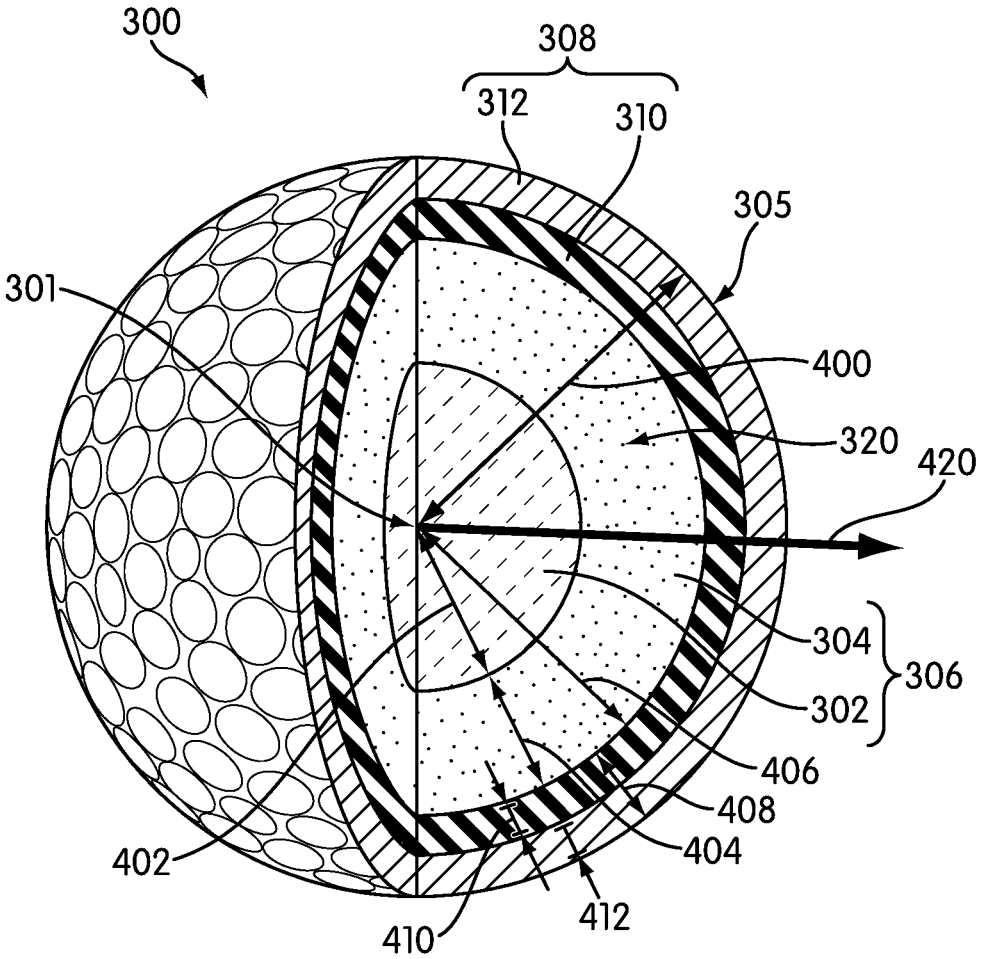
FIG. 2 shows a second representative golf ball, having an inner core, an outer core, an inner cover layer, and an outer cover layer.

FIG. 2 shows a second embodiment of a golf ball in accordance with this disclosure. Golf ball 300 is a four-piece golf ball. Namely, golf ball 300 includes inner core 302, outer core 304, inner cover layer 310, and outer cover layer 312. Inner core 302 and outer core 304 may collectively be referred to as core 306, while inner cover layer 310 and outer cover layer 312 may collectively be referred to as cover layer 308.

Golf ball 300 includes radius 400 that extends from center 301 to outer surface 305. Each component may also have the dimensions as shown in FIG. 2. Namely, inner core 302 may have radius 402, outer core 304 may have thickness 404, core 306 may have radius 406, inner cover layer 310 may have thickness 410, outer cover layer may have thickness 412, and cover layer 308 may have thickness 408.

Golf ball 300 may be substantially similar in many respects to golf ball 100, discussed above. The compositions of inner core 302 and outer core 304 may be substantially the same as inner core 102 and outer core 104, respectively. Namely, inner core 302 is a polymer with substantially no filler, which outer core 304 is a polymer with filler. The physical properties and dimensions of inner core 302 and outer core 304 may also be substantially the same as inner core 102 and outer core 104, respectively. Therefore, core 306 may be substantially the same as core 106. However, in other embodiments, inner core 302 and outer core 304 may have different dimensions. Namely, the radius of inner core 302 may be different from the radius of inner core 102, and the thickness of outer core 304 may be different from the thickness of outer core 104.

Golf ball 300 may have moment of inertia 420, as described above with respect to moment of inertia 220.

Figure 3:
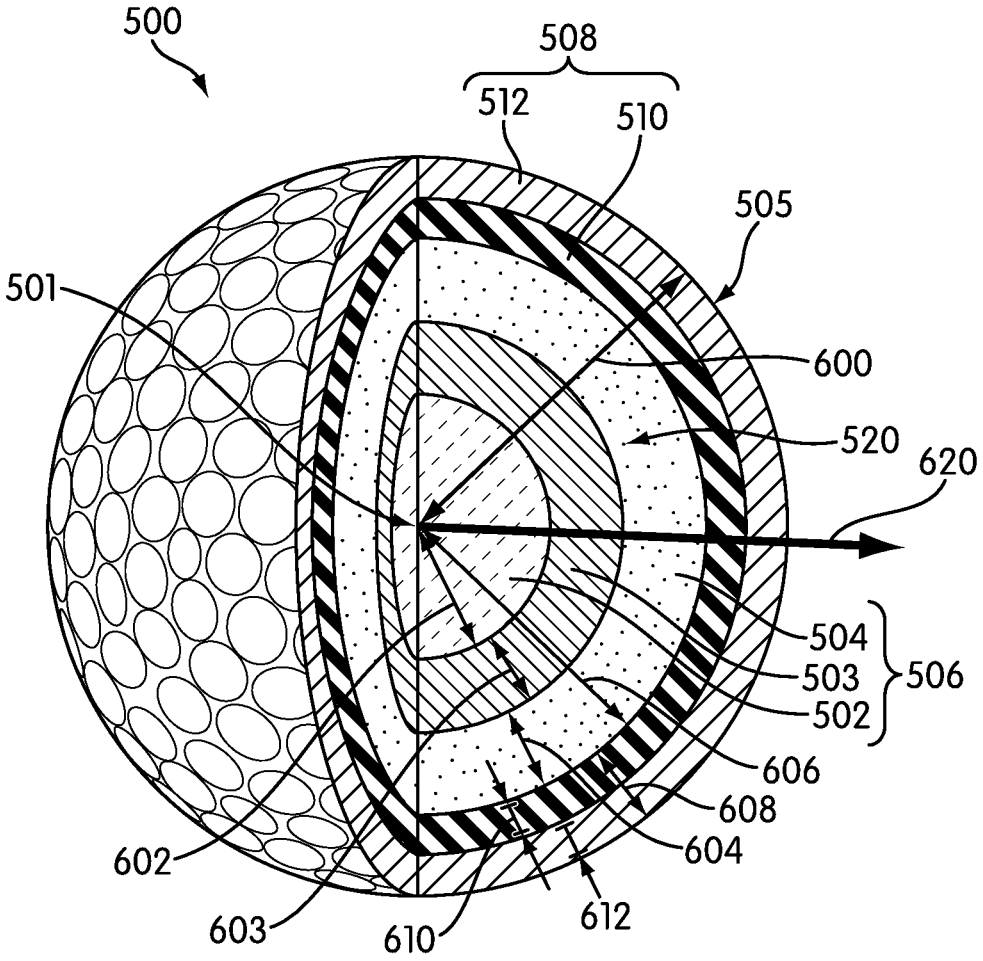
FIG. 3 shows a third representative golf ball, having an inner core, an intermediate core, an outer core with fillers, an inner cover layer, and an outer cover layer.

FIG. 3 shows a third representative golf ball 500. Golf ball 500 includes inner core 502, intermediate core 503, outer core 504, inner cover layer 510, and outer cover layer 512.

Generally, golf ball 500 differs from previous embodiments shown in FIGS. 1 and 2 in that core 506 of golf ball 500 includes three sub-components (inner core 502, intermediate core 503, and outer core 504), as opposed to the two sub-components (inner core 302 and outer core 304) that make up core 306, for example. Core 506 may therefore be referred to as a three-piece core.

In the embodiment show in FIG. 3, golf ball 500 may have dimensions as shown. First, inner core 502 may have radius 602. Radius 602 may be smaller than radius 402 of inner core 302 in golf ball 300. Intermediate core 503 may have thickness 603, and outer core 504 may have thickness 604. Generally, core 506 may have radius 606. Radius 606 may be the same as, or different from, radius 406 of core 306 in golf ball 300. In one particular embodiment, radius 606 may have a value such that twice radius 606 (i.e. diameter of core 506) is substantially equal to 1.52 inches. Thickness 610 of inner cover layer 510, thickness 612 of outer cover layer 512, and thickness 608 of cover layer 508, may be substantially as discussed above with respect to other various embodiments. Golf ball 500 also includes center point 501 and outer surface 505, the distance between these being radius 600. In some embodiments, radius 600 may have a value in accordance with USGA rules.

As shown in FIG. 3, outer core 504 may include fillers 520. Fillers 520 may be as discussed variously above. In contrast, in golf ball 500, neither inner core 502 nor intermediate core 503 may include substantially any fillers. This configuration may result in golf ball 500 having moment of inertia 620. The value of moment of inertia 620 may be as discussed above with respect to moment of inertia 220 of golf ball 100.

Figure 4:
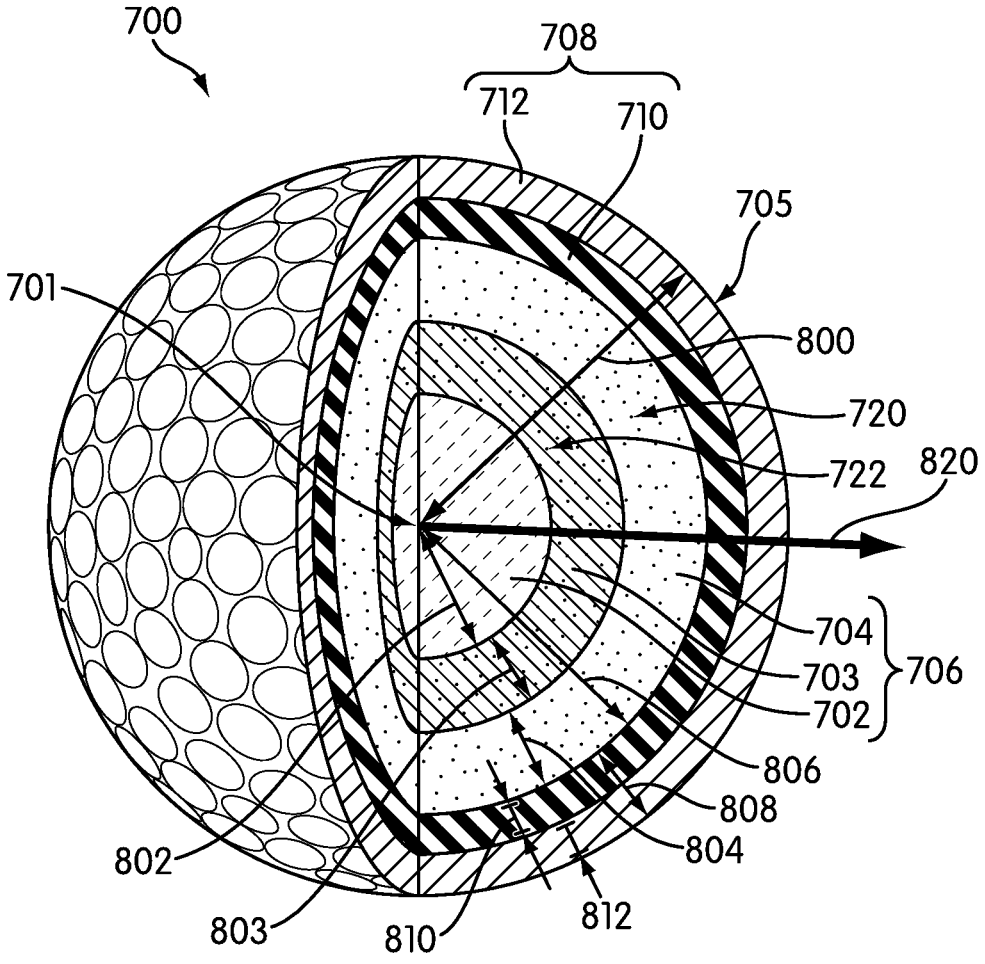
FIG. 4 shows a fourth representative golf ball, having an inner core, an intermediate core with fillers, an outer core with fillers, an inner cover layer, and an outer cover layer.

FIG. 4 shows a fourth representative golf ball 700. Golf ball 700 includes an inner core 702, an intermediate core 703, an outer core 704, an inner cover layer 710, and an outer cover layer 712. Golf ball 700 includes core 706 that is also a three-piece core. Golf ball 700 may be referred to as five-piece golf ball, as it includes three-piece core 702 and two cover layers 708.

In the embodiment show in FIG. 4, golf ball 700 may have dimensions as shown. First, inner core 702 may have radius 802. Radius 802 may be the same as or different from radius 602 in golf ball 500, and (as mentioned above) may be smaller than radius 402 of inner core 302 in golf ball 300. Intermediate core 703 may have thickness 803, and outer core 704 may have thickness 804.

Generally, core 706 may have radius 806. Radius 806 may be the same as, or different from, radius 406 of core 306 in golf ball 300 as discussed above. In one particular embodiment, radius 806 may have a value such that twice radius 806 (i.e. diameter of core 706) is substantially equal to 1.52 inches. Thickness 810 of inner cover layer 710, thickness 812 of outer cover layer 712, and thickness 808 of cover layer 708, may be substantially as discussed above with respect to other various embodiments. Golf ball 700 also includes center point 701 and outer surface 705, the distance between these being radius 800. In some embodiments, radius 800 may have a value in accordance with USGA rules.

As shown in FIG. 4, outer core 704 may include fillers 720. Generally, golf ball 700 differs from golf ball 500 in that intermediate core 703 may include fillers 722, while intermediate core 503 in golf ball 500 does not substantially include any fillers. In contrast, in golf ball 700, only inner core 702, also sometimes referred to as the "center core" because this layer encompasses the center of the golf ball, does not include substantially any fillers. Fillers 720 and 722 may be as discussed variously above. This configuration may result in golf ball 700 having moment of inertia 820. The value of moment of inertia 820 may be as discussed above with respect to moment of inertia 220 of golf ball 100.

Generally, if additional layers are provided for any core of any embodiment provided herein, the innermost core layer is free from filler material. Any other core layer may contain filler, though in some embodiments, layers proximate the innermost core layers may also be free from filler material, as long as at least one outer core layer is provided with filler in sufficient amounts as to increase the MOI of the golf ball.

Further embodiments of golf balls in accordance with this disclosure are shown in the below examples.

EXAMPLES

The following example cores labeled A-E, and comparative example cores V-Z, were manufactured and tested as described below.

First, several exemplary inner cores were manufactured and tested as shown in Table 1, as were corresponding comparative examples. In Table 1 and Table 2 below, comparative examples are arranged vertically below the example to which they are most comparable. The examples are made in accordance with the teachings of this disclosure, namely, where the innermost core layer contains no or substantially no filler material while the outer core contains filler material.

TABLE 1

| Inner Cores | | | | | |
|---|---|---|---|---|---|
| | Example: | | | | |
| | A | B | C | D | E |
| Weight % HNP AD1035 | 100.0 | 100.0 | 100.0 | 75.0 | 50.0 |
| Weight % HNP HPF2000 | 0.0 | 0.0 | 0.0 | 25.0 | 50.0 |
| Weight % $BaSO_4$ filler | 0.0 | 0.0 | 0.0 | 0.0 | 0.0 |
| Total weight (g) | 3.545 | 10.205 | 16.754 | 16.737 | 16.560 |
| Diameter (inches) | 0.751 | 1.071 | 1.266 | 1.266 | 1.261 |
| Specific gravity (g/cm$^3$) | 0.975 | 0.969 | 0.963 | 0.962 | 0.962 |
| Compression | 169.9 | 140.2 | 131.9 | 118.5 | 110.0 |
| Hardness (Shore D) | 40.6 | 39.5 | 37.0 | 39.5 | 40.6 |
| | Comparative Example: | | | | |
| | V | W | X | Y | Z |
| Weight % HNP AD1035 | 84.7 | 84.7 | 84.7 | 21.2 | 21.2 |
| Weight % HNP HPF2000 | 0.0 | 0.0 | 0.0 | 63.5 | 63.5 |
| Weight % $BaSO_4$ filler | 15.3 | 15.3 | 15.3 | 15.3 | 15.3 |
| Total weight (g) | 4.288 | 11.851 | 19.406 | 19.381 | 19.406 |
| Diameter (inches) | 0.751 | 1.074 | 1.260 | 1.261 | 1.259 |
| Specific gravity (g/cm$^3$) | 1.179 | 1.114 | 1.131 | 1.126 | 1.132 |
| Compression | 161.6 | 126.6 | 120.2 | 106.2 | 96.3 |
| Hardness (Shore D) | 42.0 | 40.2 | 39.1 | 41.0 | 42.2 |

The highly neutralized acid polymers AD1035 and HPF2000 are both commercially available from E.I. DuPont de Nemours & Co.

The values of the various physical properties were measured and calculated as discussed herein above, or as is known to a person having ordinary skill in the art of golf ball manufacturing.

Next, an outer core was formed around each inner core to form a completed core. The composition of each outer core is shown in Table 2.

TABLE 2

| Outer Cores | | | | | |
|---|---|---|---|---|---|
| | Example: | | | | |
| | A | B | C | D | E |
| Weight % HNP AD1035 | 0.0 | 0.0 | 0.0 | 0.0 | 0.0 |
| Weight % HNP HPF2000 | 83.0 | 78.0 | 69.3 | 69.3 | 69.3 |
| Weight % $BaSO_4$ filler | 17.0 | 22.0 | 30.7 | 30.7 | 30.7 |
| | Comparative Example: | | | | |
| | V | W | X | Y | Z |
| Weight % HNP AD1035 | 0.0 | 0.0 | 0.0 | 0.0 | 0.0 |
| Weight % HNP HPF2000 | 84.7 | 84.7 | 84.7 | 84.7 | 84.7 |
| Weight % $BaSO_4$ filler | 15.3 | 15.3 | 15.3 | 15.3 | 15.3 |

The completed cores were measured and tested as shown in Table 3.

TABLE 3

| Total Cores (including inner & outer) | | | | | |
|---|---|---|---|---|---|
| | Example: | | | | |
| | A | B | C | D | E |
| Total weight (g) | 32.787 | 33.255 | 32.850 | 33.016 | 32.938 |
| Diameter (inches) | 1.516 | 1.510 | 1.521 | 1.522 | 1.518 |
| Specific gravity (g/cm$^3$) | 1.097 | 1.127 | 1.087 | 1.092 | 1.098 |
| Compression | 87.0 | 100.3 | 112.0 | 103.4 | 96.3 |
| Hardness (Shore D) | 43.6 | 43.9 | 43.3 | 43.8 | 43.4 |
| COR Predicted | 0.818 | 0.808 | 0.799 | 0.805 | 0.812 |
| COR Measured | 0.823 | 0.816 | 0.815 | 0.823 | 0.830 |
| $\Delta(COR_M - COR_P)$ | 0.011 | 0.008 | 0.016 | 0.018 | 0.018 |
| % $\Delta(COR_M - COR_P)$ | 1.33% | 1.05% | 1.96% | 2.26% | 2.20% |
| | Comparative Example: | | | | |
| | V | W | X | Y | Z |
| Total weight (g) | 33.560 | 32.384 | 32.958 | 33.555 | 33.646 |
| Diameter (inches) | 1.517 | 1.510 | 1.518 | 1.518 | 1.517 |
| Specific gravity (g/cm$^3$) | 1.121 | 1.096 | 1.099 | 1.119 | 1.123 |
| Compression | 83.6 | 99.0 | 107.7 | 96.8 | 90.0 |
| Hardness (Shore D) | 41.6 | 42.0 | 42.4 | 41.2 | 43.3 |
| COR Predicted | 0.818 | 0.809 | 0.799 | 0.806 | 0.811 |
| COR Measured | 0.819 | 0.809 | 0.796 | 0.806 | 0.814 |
| $\Delta(COR_M - COR_P)$ | 0.001 | 0.0 | −0.003 | 0.0 | 0.003 |
| % $\Delta(COR_M - COR_P)$ | 0.10% | 0.0% | −0.41% | 0.0% | 0.39% |

The "COR Predicted" was calculated according to the following formula:

$$\text{Predicted } COR = \frac{\text{Volume inner}}{\text{Total Volume}} * COR \text{ inner} + \frac{\text{Volume outer}}{\text{Total Volume}} * COR \text{ outer} \quad \text{(Formula 1)}$$

In Formula I, the total volume of the core is the sum of the volume of the inner component and the volume of the outer component. The "COR inner" is determined by measuring the COR of the material making up the inner material, namely by measuring a uniform sphere of the material having a diameter of (for example) 1.55 inches under the same COR testing conditions (for example, 125 ft/sec). The "COR outer" is measured in the same manner with respect to the material making up the outer component.

As shown in the above tables, the Examples showed a greater measured COR than predicted COR. Conversely, the measured COR of the comparative examples did not significantly differ from the predicted COR value.

Figure 5:
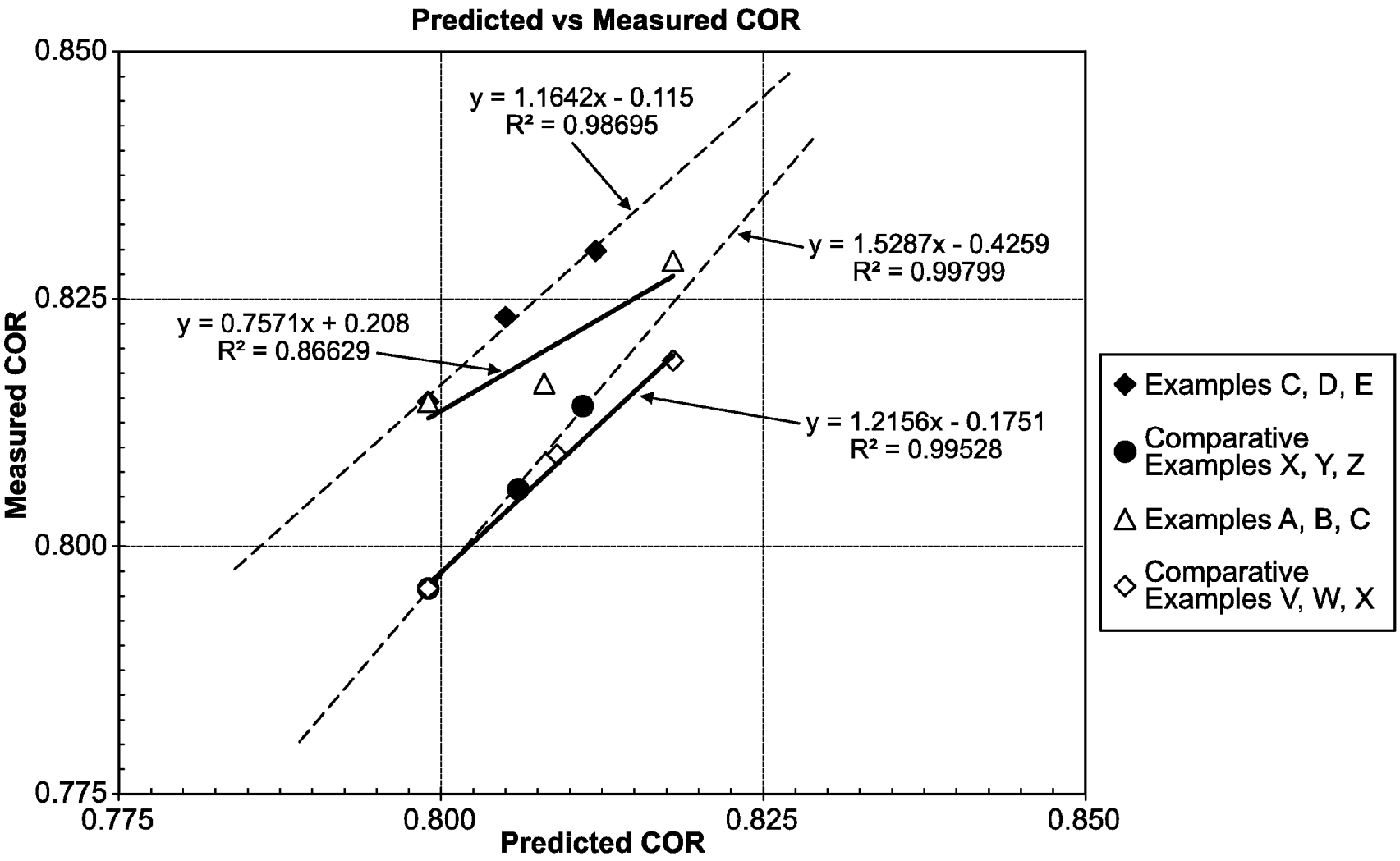
FIG. 5 is a graph of measured COR versus predicted COR for several example cores in accordance with this disclosure, and comparative examples.

FIG. 5 shows these results graphical form. Specifically, FIG. 5 shows a scatter plot of the measured COR values against the predicted COR values for each of the examples made in accordance with this disclosure and comparative examples. The "1:1 ratio" line that bisects the graph shows where the measured COR value is equal to the predicted COR value. Data points falling along or substantially near the "1:1 ratio" line are expected according to known COR prediction methods, as discussed above. FIG. 5 shows that the comparative examples fell on or very near this line. In contrast, FIG. 5 visually shows that each of the examples made in accordance with this disclosure had a measured COR value that exceeded the predicted COR value.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball comprising:

a core comprising an inner core consisting essentially of a first highly neutralized acid polymer, and an outer core layer substantially surrounding the inner core and consisting essentially of a second highly neutralized acid polymer composition and a filler; and a cover layer substantially surrounding the core;

wherein the inner core contains less than about 0.01% by weight of a first filler; and the outer core layer contains from about 17.0% to about 30.7% by weight of a second filler, and from about 69.3% to about 83.0% by weight of the second highly neutralized acid polymer.

2. The golf ball according to claim 1, wherein the inner core has an inner core diameter of from about 0.751 inches to about 1.266 inches.

3. The golf ball according to claim 1, wherein the core has a core diameter of about 1.5 inches.

4. The golf ball according to claim 1, wherein the inner core has an inner core specific gravity of about 0.96.

5. The golf ball according to claim 1, wherein the core has a core specific gravity of from about 1.09 to about 1.13.

6. The golf ball according to claim 1, wherein the inner core has an inner core compression value of from about 110 to about 170.

7. The golf ball according to claim 1, wherein the core has a core compression value of from about 87 to about 112.

8. The golf ball according to claim 1, wherein the inner core has an inner core hardness value of from about Shore D 37 to about 41.

9. The golf ball according to claim 1, wherein the core has a core hardness value of about Shore D 43.

10. A golf ball comprising:

a core, the core comprising an inner core and an outer core;

the inner core consisting essentially of a first highly neutralized acid polymer and less than about 0.01% by weight of a first filler, the inner core having an inner core diameter of from about 0.751 inches to about 1.266 inches, an inner core specific gravity of about 0.96, an inner core compression value of from about 110 to about 170, and an inner core hardness value of from about Shore D 37 to about 41;

wherein the outer core substantially surrounds the inner core, and wherein the outer core consists essentially of from about 69.3% to about 83.0% by weight of a second highly neutralized acid polymer and from about 17.0% to about 30.7% by weight of a second filler, wherein the second filler is $BaSO_4$;

the core having a core diameter of about 1.5 inches, a core specific gravity of from about 1.09 to about 1.13, a core compression value of from about 87 to about 112, and a core hardness value of about Shore D 43; and a cover layer, wherein the cover layer substantially surrounds the core.

11. The golf ball according to claim 10, wherein the core has a measured coefficient of restitution that is greater than a predicted coefficient of restitution for the core.

12. The golf ball according to claim 10, wherein the measured coefficient of restitution of the core is at least about 1% greater than the predicted coefficient of restitution for the core.

13. The golf ball according to claim 10, wherein the measured coefficient of restitution of the core is at least about 2% greater than the predicted coefficient of restitution for the core.

* * * * *